US011718981B2

(12) United States Patent
Tone et al.

(10) Patent No.: US 11,718,981 B2
(45) Date of Patent: Aug. 8, 2023

(54) TANK DEVICE

(71) Applicant: TOTO LTD., Kitakyushu (JP)

(72) Inventors: Yusuke Tone, Kitakyushu (JP); Shu Kashirajima, Kitakyushu (JP); Yuuki Shinohara, Kitakyushu (JP); Koji Shibuya, Kitakyushu (JP)

(73) Assignee: TOTO LTD., Kitakyushu (JP)

( * ) Notice: Subject to any disclaimer, the term of this patent is extended or adjusted under 35 U.S.C. 154(b) by 0 days.

(21) Appl. No.: 17/476,193

(22) Filed: Sep. 15, 2021

(65) Prior Publication Data

US 2022/0090368 A1 Mar. 24, 2022

(30) Foreign Application Priority Data

Sep. 18, 2020 (JP) ..... 2020-157200

(51) Int. Cl.
*E03D 1/012* (2006.01)
*E03D 1/26* (2006.01)

(52) U.S. Cl.
CPC ..... *E03D 1/012* (2013.01); *E03D 1/26* (2013.01); *E03D 2201/20* (2013.01)

(58) Field of Classification Search
CPC ..... E03D 1/102; E03D 1/012
USPC ..... 4/234
See application file for complete search history.

(56) References Cited

U.S. PATENT DOCUMENTS 2,807,024 A * 9/1957 Kapp ..... E03D 1/32 4/353
3,319,913 A * 5/1967 Schoepe ..... E03D 1/32 4/353

FOREIGN PATENT DOCUMENTS

JP 2012-31616 A 2/2012
JP 2020-051236 A 4/2020

OTHER PUBLICATIONS

Notice of Reasons for Refusal issued in Japanese Patent application 2020-157200 dated Aug. 24, 2022.

* cited by examiner

*Primary Examiner* — Christine J Skubinna
(74) *Attorney, Agent, or Firm* — BakerHostetler

(57) ABSTRACT

Provided is a tank device capable of restraining splashing of flush water during water supply to suppress a water slapping sound. A tank device for supplying flush water stored therein to a flush toilet comprises: a tank main unit for storing flush water in an internal space 24C thereof defined by an inner wall surface which comprises a transverse surface 27B extending in a transverse direction and a standing surface 27A extending in an up-down direction; and a water supply member 26 for supplying flush water from a water supply port 26A to the internal space of the tank main unit, the water supply member 26 being configured to spout flush water toward the inner wall surface defining the internal space 24C, wherein the tank main unit comprises a flow rectifying portion 46 provided in a region of the inner wall surface to which flush water is spouted, the flow rectifying portion 46 having a convex part 46A and a concave part 46B each formed on the inner wall surface.

9 Claims, 6 Drawing Sheets

TANK DEVICE

CROSS-REFERENCE TO RELATED APPLICATIONS

This application claims priority to foreign Japanese patent application No. JP 2020-157200, filed on Sep. 18, 2020, the disclosure of which is incorporated by reference in its entirety.

TECHNICAL FIELD

The present invention relates to a tank device.

BACKGROUND ART

Conventionally, a flush toilet comprises a tank device and a toilet main unit, wherein the flush toilet is configured to spout flush water stored in the tank device into a bowl portion of the toilet main unit, thereby carrying out flushing or cleaning of the bowl portion. The tank device is configured to be externally supplied with flush water such that the flush water is spouted from a spout located on the upper side of a tank toward a water surface in the tank. In such a tank device, due to collision of the spouted flush water against the water surface in the tank, a water slapping sound is undesirably generated to give a user an uncomfortable feeling.

As a measure against this problem, the below-mentioned Patent Document 1 discloses a tank device configured such that an inclined surface is provided below a spout to allow flush water spouted from the spout to flow along a wall surface of a tank, thereby making it possible to suppress the water slapping sound.

CITATION LIST

Patent Document

Patent Document 1: JP-A 2020-051236

SUMMARY OF INVENTION

Technical Problem

However, in the invention described in the Patent Document 1, upon collision with the inclined surface, the flush water splashes toward all circumferential directions of the tank, and spreads out widely to form a water puddle on the inclined surface. Thus, there still remains a problem that the water slapping sound is generated when flush water is slapped against the water puddle formed on the inclined surface in the above manner.

The present invention has been made in view of the above problem, and an object thereof is to provide a tank device capable of restraining spreading of flush water during water supply to suppress the water slapping sound.

Solution to Technical Problem

The present invention provides a tank device for supplying flush water stored therein to a flush toilet comprising: a tank main unit for storing flush water in an internal space thereof defined by an inner wall surface which comprises a transverse surface extending in a transverse direction and a standing surface extending in an up-down direction; and a water supply member for supplying flush water from a water supply port to the internal space of the tank main unit, the water supply member being configured to spout flush water toward the inner wall surface defining the internal space, wherein the tank main unit comprises a flow rectifying portion provided in a region of the inner wall surface to which flush water is spouted, the flow rectifying portion having a concave part and/or a convex part each formed on the inner wall surface. In the tank device of the present invention having the above feature, the flow rectifying portion comprised of the concave part and/or the convex part is provided in the region of the inner wall surface to which flush water is spouted, so that it is possible to suppress spreading of flush water colliding with the flow rectifying portion, and smoothly guide the flush water toward a downstream side of the flow of flush water through the flow rectifying portion, thereby restraining retention of the flush water to suppress the water slapping sound.

Preferably, in the tank device of the present invention, the concave part and/or the convex part extend toward a downstream side of a flow of the flush water. According to this feature, flush water spouted to the flow rectifying portion quickly flows toward the downstream side while being guided by the concave part and/or the convex part, so that it is possible to prevent the retention of the flush water to suppress the water slapping sound.

Preferably, in the tank device of the present invention, the water supply member is configured to spout the flush water toward the standing surface, and the flow rectifying portion is formed on the standing surface. According to this feature, the flow rectifying portion is formed on the standing surface, so that the spouted flush water is quickly led toward the downstream side. This makes it possible to suppress areal spreading of the flush water.

Preferably, in the tank device of the present invention, at least the region of the inner wall surface provided with the flow rectifying portion is formed to protrude outwardly. According to this feature, the region of the inner wall surface provided with the flow rectifying portion protrudes outwardly, so that it is possible to suppress spreading of the flush water spouted to the flow rectifying portion.

Preferably, in the tank device of the present invention, a wall surface of the tank main unit located on a downstream side of a flow of the flush water with respect to the flow rectifying portion is linearly formed in sectional view. According to this feature, the flush water spouted to the flow rectifying portion quickly flows toward the downstream side, so that it is possible to prevent the spreading of the flush water.

Preferably, in the tank device of the present invention, the inner wall surface includes an inclined surface located on an upstream side of a flow of the flush water with respect to the flow rectifying portion, wherein the inclined surface inclines from an inward side toward an outward side in sectional view. According to this feature, it is possible to prevent the flush water spouted to the flow rectifying portion from spreading toward the upstream side, and, even when the flush water spreads from the flow rectifying portion toward the upstream side, quickly lead the flush water to the flow rectifying portion.

Preferably, in the tank device of the present invention, the tank main unit comprises: a connection tank in which the water supply port is disposed; and a water storage tank for storing therein the supplied flush water, wherein the flow rectifying portion is formed on an inner wall surface of the connection tank. According to this feature, flush water vigorously spouted from the water supply port by a water supply pressure is received by the flow rectifying portion in the connection tank, and then supplied to the water storage tank, so that it is possible to prevent the flush water vigorously spouted by the action of the water supply pressure from being slapped directly against a water surface, thereby further suppressing the water slapping sound.

Effect of Invention

The present invention can provide a tank device capable of restraining spreading of flush water during water supply to suppress the water slapping sound.

DESCRIPTION OF EMBODIMENTS

Figure 1:
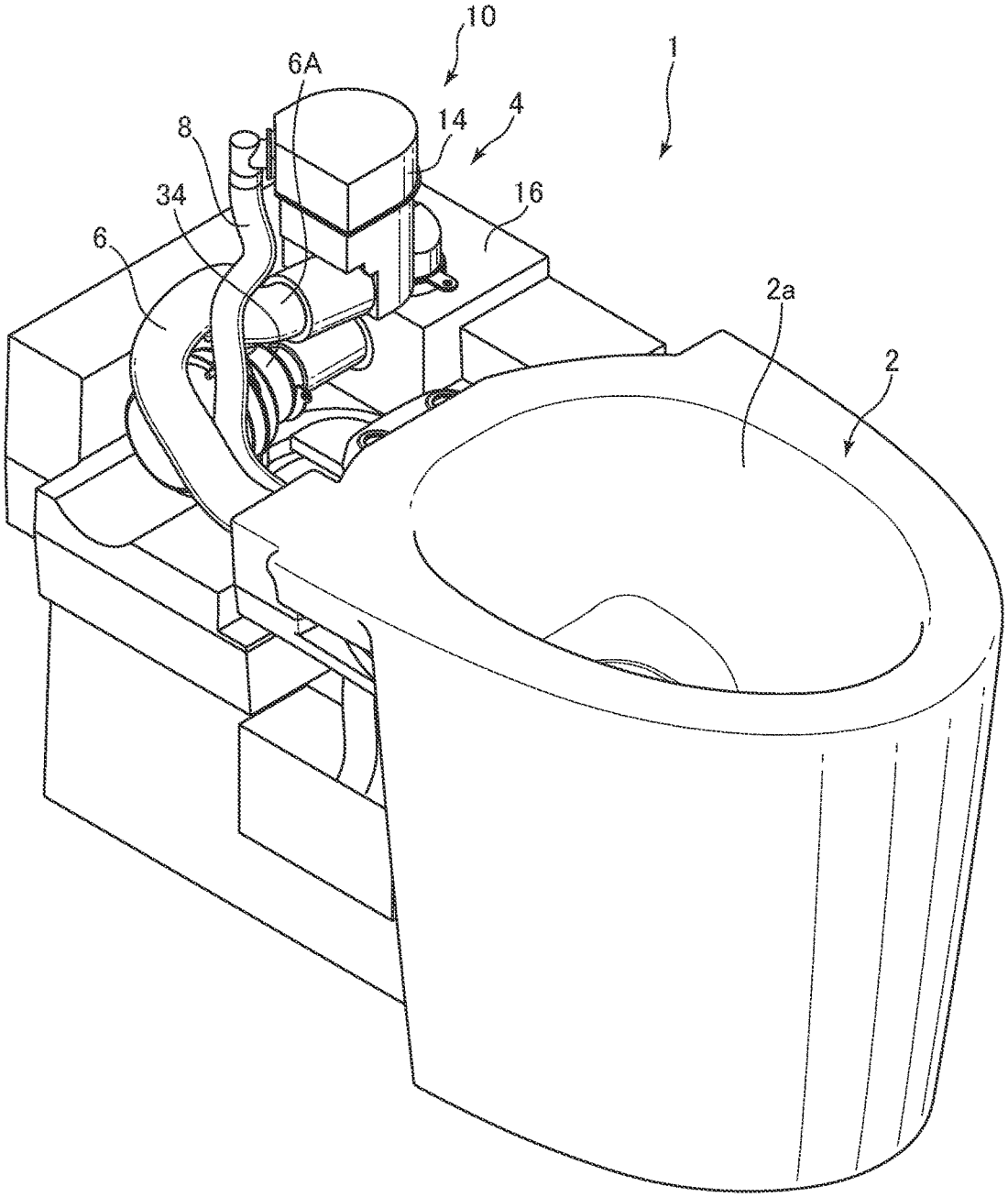
FIG. 1 is a perspective view showing a flush toilet apparatus according to one embodiment of the present invention.
Figure 2:
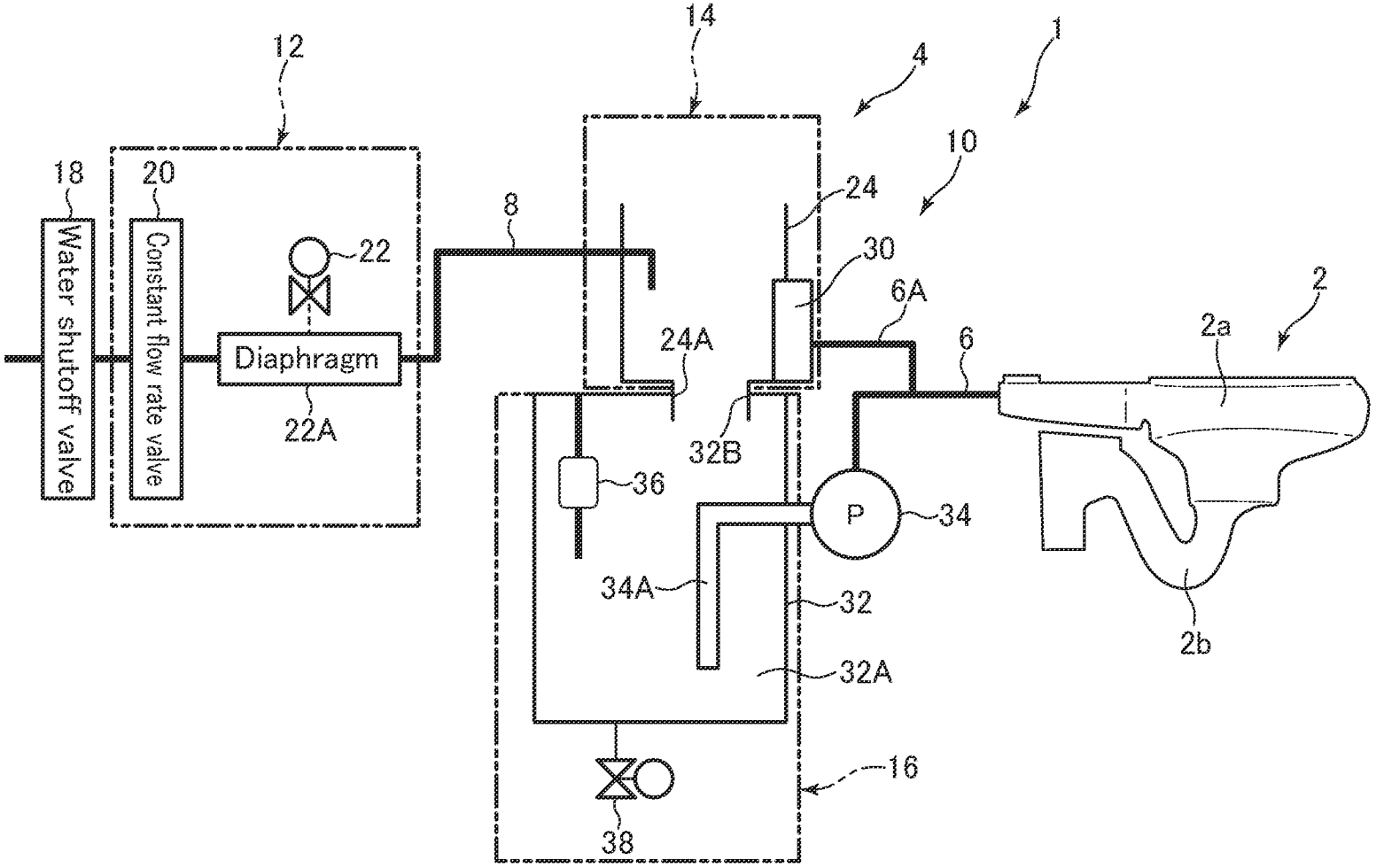
FIG. 2 is a configuration diagram showing the configuration of the flush toilet apparatus according to this embodiment.

With reference to the drawings, one embodiment of a flush toilet apparatus comprising a tank device of the present invention will be described in detail. FIG. 1 is a perspective view showing a flush toilet apparatus according to one embodiment of the present invention. Further, FIG. 2 is a configuration diagram showing the configuration of the flush toilet apparatus according to this embodiment. As shown in FIG. 1, the flush toilet apparatus 1 according to this embodiment comprises a toilet main unit 2 and a tank device 4.

The toilet main unit 2 has a bowl portion 2*a* for receiving waste, and a drainage trap conduit 2*b* extending from the bottom of the bowl portion 2*a*. A water spouting pipe 6 extending from the tank device 4 is connected to the bowl portion 2*a*.

A water supplying pipe 8 externally supplied with flush water is connected to the tank device 4. A water shutoff valve 18 is interposed in the water supplying pipe 8 so as to control supply of flush water to the tank device 4. The water spouting pipe 6 extending from the tank device 4 to the toilet main unit 2 can supply flush water from the tank device 4 to the toilet main unit 2 to perform flushing or cleaning after defecation.

The tank device 4 comprises a valve unit 12 and a tank main unit 10. The tank main unit 10 comprises a connection tank 14 and a water storage tank 16. The water supplying pipe 8 is connected to the connection tank 14 via the valve unit 12. The connection tank 14 is connected to the water storage tank 16.

The valve unit 12 comprises: a constant flow rate valve 20 provided in the water supplying pipe 8; and a diaphragm solenoid valve 22 provided downstream of the constant flow rate valve 20. The constant flow rate valve 20 is operable to keep the flow rate of flush water flowing through the water supplying pipe 8 constant. The solenoid valve 22 is configured to electromagnetically open and close a diaphragm 22A, thereby controlling supply of flush water to the water storage tank 16 through the connection tank 14.

Figure 3:
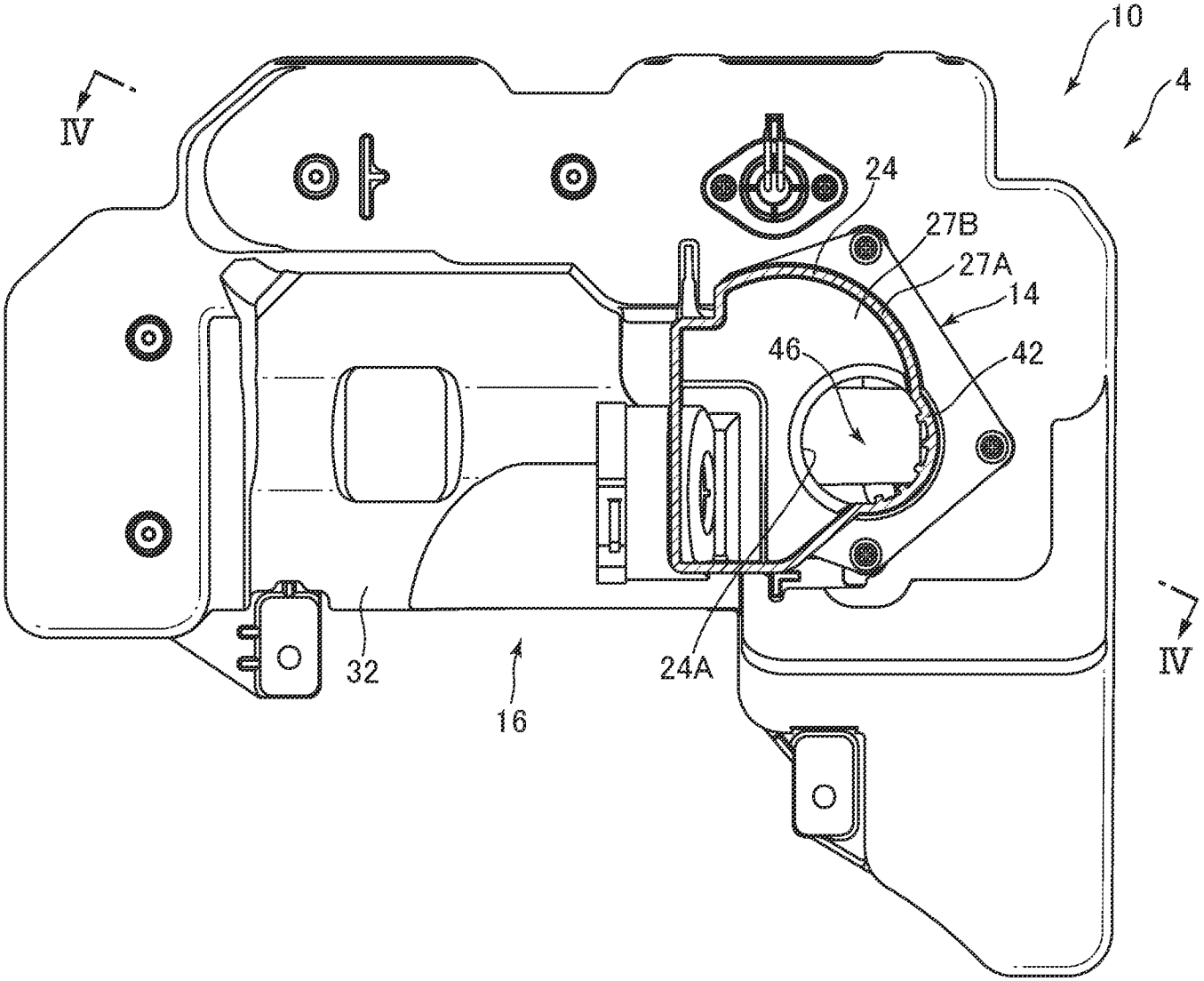
FIG. 3 is a horizontal sectional view of a tank device of the flush toilet apparatus illustrated in FIG. 1.
Figure 4:
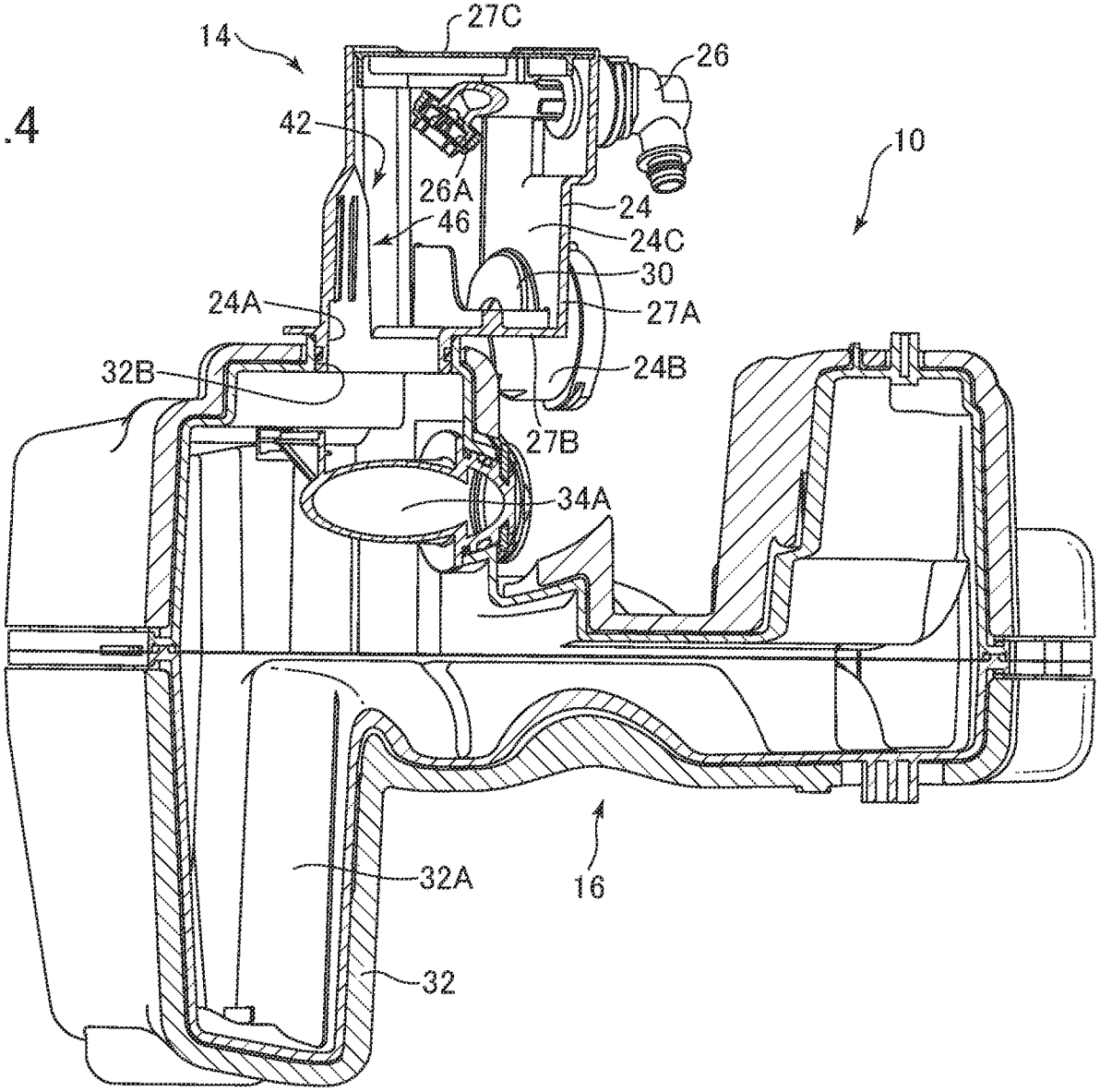
FIG. 4 is a sectional view taken along the line IV-IV in FIG. 3.
Figure 5:
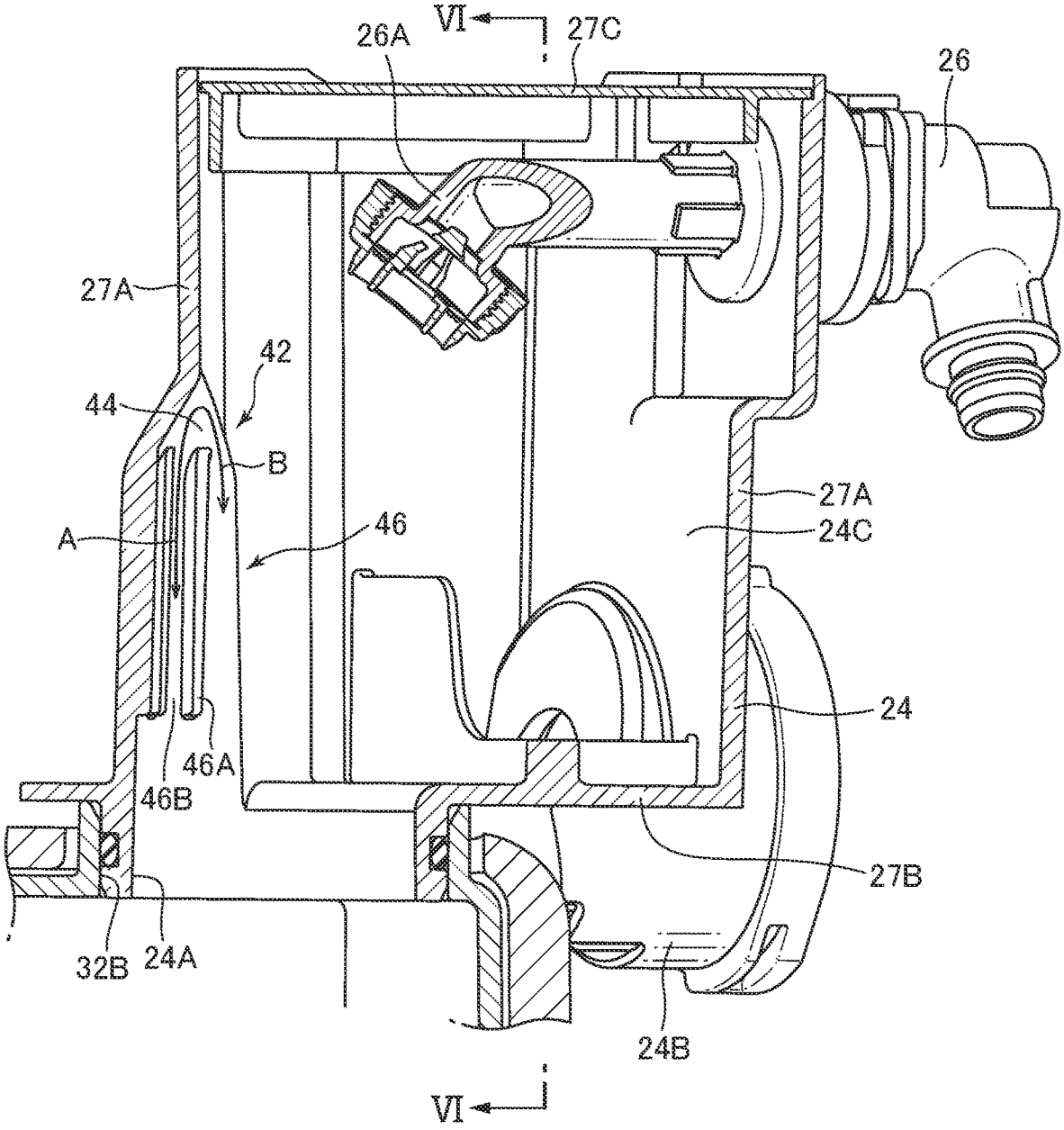
FIG. 5 is an enlarged vertical sectional view of a connection tank in the tank device illustrated in FIG. 4.
Figure 6:
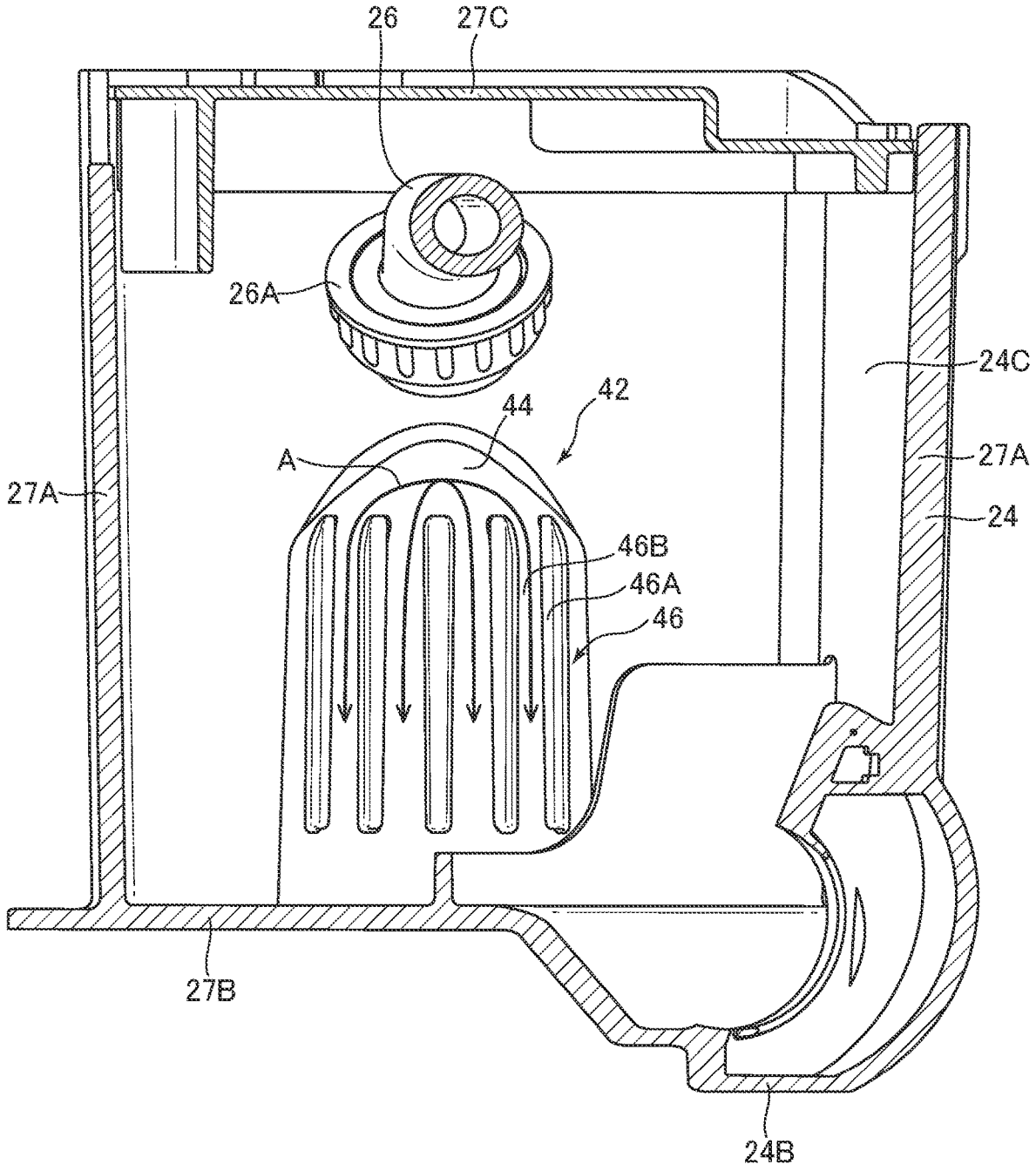
FIG. 6 is a sectional view taken along the line VI-VI in FIG. 5.

FIG. 3 is a horizontal sectional view of the tank device of the flush toilet apparatus illustrated in FIG. 1. FIG. 4 is a sectional view taken along the line IV-IV in FIG. 3. FIG. 5 is an enlarged vertical sectional view of the connection tank in the tank device illustrated in FIG. 4. FIG. 6 is a sectional view taken along the line VI-VI in FIG. 5. As shown in FIGS. 3 and 4, the connection rank 14 has a housing 24. The connection tank 14 is detachably connected to an upper portion of the water storage tank 16. The housing 24 has: a transverse surface 27B (inner surface of a bottom wall thereof) formed to extend in a transverse direction; a standing surface 27A (inner surface of a tubular-shaped side wall thereof) formed to stand upright around the transverse surface 27B; and a top surface 27C (inner surface of a top wall thereof) closing the upper side of the standing surface 27A. The housing 24 internally has an approximately columnar-shaped internal space 24C defined by an inner wall surface comprised of the transverse surface 27B, the standing surface 27A and the top surface 27C.

The housing 24 has a tubular-shaped water supply opening 24A formed on one side of the bottom wall 27B to extend downwardly, and an overflow opening 24B formed in a lower region on one side (right side in FIG. 5) of the side wall. An overflow pipe 6A (FIGS. 1 and 2) is arranged such that one end thereof is connected to the overflow opening 24B, and the other end thereof is connected to the water spouting pipe 6. The height position of a lower edge of the overflow opening 24B defines an overflow water level. Further, a check valve 30 (FIG. 2) is attached to the overflow opening 24B. The check valve 30 is configured to allow flush water to flow from the internal space 24C of the housing 24 to the overflow pipe 6A, and prevent flush water from flowing from the overflow pipe 6A to the internal space 24C of the housing 24. The water supply opening 24A of the housing 24 is detachably connected to an opening 32B of the after-mentioned tank body 32 of the water storage tank 16.

The housing has a protruded portion 42 formed in a part (left region in FIG. 5) of the standing surface 27A to protrude outwardly. The protruded portion 42 has an arc-like shape in horizontal section, wherein a wall surface forming the protruded portion 42 is continuous with a wall surface forming the water supply opening 24A. That is, as shown in FIG. 5, an inner wall surface of the protruded portion 42 is aligned to the same straight line with the water supply opening 24A in vertical section. An inclined surface 44 is formed on the upper side of the protruded portion 42. The inclined surface 44 is formed in a shape gradually protruding outwardly as going downwardly and continuously connecting to the protruded portion 42.

A flow rectifying portion 46 is formed on an inner surface of the protruded portion 42. The flow rectifying portion 46 has a plurality of convex parts 64A formed such that one or more concave parts 46B are formed between adjacent ones of the convex parts 64A. Each of the convex parts 64A extends in an approximately vertical direction (in an up-down direction), i.e., extends in a direction toward the water supply opening 24A which is a downstream direction of the flow of flush water. Further, each of the convex parts 64A is formed in a rectangular shape in transverse section, and is provided to stand toward a center of the water supply opening 24A. In this embodiment, five convex parts 64A are arranged in parallel at even intervals in a circumferential direction of the side wall 27A.

In an upper region on one side (right side in FIG. 5) of the standing surface 27A, the housing 24 is provided with a water supply member 26 connected to the water supplying pipe 8 and having a water supply port 26A from which flush water is supplied to the internal space 24C of the housing 24. The water supply member 26 is provided such that flush water spouted from the water supply port 26A hits the flow rectifying portion 46. More specifically, in transverse sectional view (plan view), a water spouting direction of the water supply port 26A is oriented to a transverse center of the flow rectifying portion 46, and, in up-down directional sectional view (vertical sectional view), the water spouting direction of the water supply port 26A is oriented above a height-directional center of the flow rectifying portion 46.

The water storage tank 16 comprises a tank body 32, a pump unit 34, a float switch 36, and a drain plug 38. The tank body 32 is formed in an angular C shape in horizontal sectional view, wherein a storage part 32A is formed thereinside. Further, an opening 32B is formed in a top portion of the tank body 32, and the water supply opening 24A of the housing 24 is connected to the opening 32B. This allows the internal space 24C of the housing 24 to be communicated with the storage part 32A of the tank body 32.

A water passing pipe 34A and the water spouting pipe 6 are connected to the pump unit 34. An inlet end of the water passing pipe 34A is disposed in a lower region of an internal space of the storage part 32A of the tank body 32. When the pump unit 34 is driven by a user of the flush toilet apparatus 1, the pump unit 34 sucks flush water in the storage part 32A of the tank body 32, through the water passing pipe 34A, and sends the flush water to the water spouting pipe 6. The flush water sent to the water spouting pipe 6 is spouted to the bowl portion 2*a* of the toilet main unit 2.

The float switch 36 is operable to detect a water level in the tank body 32. The float switch 36 is interlockingly engaged with the solenoid valve 22 of the valve unit 12. Specifically, the solenoid valve 22 is configured to open the water supplying pipe 8 when the water level in the tank body 32 is equal to or less than a given water level (given water height), and close the water supplying pipe 8 when the water level in the tank body 32 reaches the given water level.

The drain plug 38 is provided in the bottom of the tank body 32. The drain plug 38 is closed in a normal state, and, when needed, can be opened so as to discharge flush water in the tank body 32 to the outside.

Next, the operation of the flush toilet apparatus 1 according to this embodiment will be described. Flush water is stored in the storage part 32A inside the tank body 32 of the water storage tank 16. When the user manipulates a remote controller or the like to activate a flushing switch of the flush toilet apparatus 1, the pump unit 34 is driven, so that the flush water in the storage part 32 of the tank body 32 is sent to the water spouting pipe 6, and spouted to the bowl portion 2*a* of the toilet main unit 2. The check valve 30 is installed in the overflow opening 24B of the connection tank 14. Thus, even when the flush water partially flows from the water spouting pipe 6 into the overflow pipe 6A in the above process, the check valve 30 can prevent such flush water from flowing in the housing 24 of the connection tank 14.

When the flush water in the storage part 32A of the tank body 32 is sucked out and thereby the water level in the storage part 32A is lowered, the float switch 36 detects the lowering of the water level. In response to detection of the lowering of the water level by the float switch 36, the water supplying pipe 8 is opened by the solenoid valve 22, so that flush water is supplied from the water supply port 26A of the water supply member 26 of the connection tank 14 toward the flow rectifying portion 46 in the housing 24 of the connection tank 14.

The flush water spouted from the water supply port 26A collides with the flow rectifying portion 46. The flow rectifying portion 46 is comprised of the convex parts 64A and the concave parts 46B. Thus, in the above process, the flush water flows downwardly (toward the downstream side) while being guided by the convex parts 64A and the concave parts 46B, as indicated by the arrowed lines A in FIGS. 5 and 6, without spreading circumferentially. Further, the flow rectifying portion 46 is formed on the protruded portion 42 protruding outwardly. This makes it possible to suppress a situation where the flush water spreads toward the outside of the protruded portion 42.

Further, in a case where the momentum of flush water spouted from the water supply port 26A is relatively strong, upon collision with the flow rectifying portion 46, the flush water partly spreads upwardly. However, since the inclined surface 44 is formed just above the flow rectifying portion 46, the flush water spreading upwardly is led toward the flow rectifying portion 46 as indicated by the arrowed line B in FIG. 5, and will flow along the convex parts 64A.

Further, since a wall surface of the flow rectifying portion 46 (bottom surfaces of the concave parts 46B) and the water supply opening 24A are linearly formed in vertical section, it is possible to allow the flush water spouted to the flow rectifying portion 46 to flow directly toward the downstream side, thereby suppressing spreading of the flush water.

The flush water supplied to the inside of the housing 24 of the connection tank 14 is poured into the storage part 32A inside the tank body 32, via the water supply opening 24A and the opening 32B of the tank body 32. Then, when the float switch 36 detects that the water level of flush water in the storage part 32A of the tank body 32 reaches the given water height, the water supplying pipe 8 is closed by the solenoid valve 22.

Here, in a case where. due to failure of the float switch 36 and/or the solenoid valve 22, the water supplying pipe 8 is not closed by the solenoid valve 22 even when the water level in the storage part 32A reaches the given water height, the supply of flush water to the storage part 32A will be continued. Then, when the water level of flush water reaches the lower edge of the overflow opening 24B of the housing 24 of the connection tank 14, excess flush water flows out from the overflow opening 24B into the overflow pipe 6A, and is discharged to the bowl portion 2*a* of the toilet main unit 2 via the water spouting pipe 6.

The above embodiment can bring out the following advantageous effects. In the above embodiment, the flow rectifying portion 46 comprised of the concave parts 46B and the convex part 46A is provided in the region of the inner wall surface to which flush water is spouted, so that it is possible to suppress spreading of flush water colliding with the flow rectifying portion 46, and smoothly guide the flush water toward the downstream side through the flow rectifying portion 46, thereby restraining retention of the flush water to suppress the water slapping sound.

In the above embodiment, the concave parts 46B and the convex parts 46A extend toward the downstream side of the flow of the flush water. Thus, the flush water spouted to the flow rectifying portion 46 is quickly guided toward the downstream side by the concave parts 46B and the convex parts 46A, so that it is possible to prevent the retention of the flush water to suppress the water slapping sound.

In the above embodiment, the water supply member 26 is configured to spout the flush water toward the standing surface 27A, and the flow rectifying portion 46 is formed on the standing surface 27A, so that the spouted flush water is quickly led toward the downstream side. This makes it possible to suppress areal spreading of the flush water.

In the above embodiment, the region of the inner wall surface provided with the flow rectifying portion 46 protrudes outwardly to form the protruded portion 42. Thus, since the protruded portion 42 protruding outwardly is formed in the region of the inner wall surface provided with the flow rectifying portion 46, it is possible to suppress spreading of the flush water spouted to the flow rectifying portion 46.

In the above embodiment, a wall surface of the water supply opening 24A located on an immediately downstream side of the flow of the flush water with respect to the flow rectifying portion 46 is linearly formed in sectional view. Thus, the flush water spouted to the flow rectifying portion 46 quickly flows toward the downstream side, so that it is possible to prevent the spreading of the flush water.

In the above embodiment, the inner wall surface includes the inclined surface 44 located on an immediately upstream side of the flow of the flush water with respect to the flow rectifying portion 46, wherein the inclined surface 44 inclines from an inward side toward an outward side in a downstream direction of a flow of the flush water in sectional view. This makes it possible to prevent the flush water spouted to the flow rectifying portion 46 from spreading toward the upstream side, and, even when the flush water spreads from the flow rectifying portion 46 toward the upstream side, quickly lead the flush water to the flow rectifying portion 46.

In the above embodiment, the tank main unit 10 comprises the connection tank 14 and the water storage tank 16, wherein the flow rectifying portion 46 is formed on the inner wall surface of the connection tank 14. Thus, flush water vigorously spouted from the water supply port 26A by a water supply pressure is received by the flow rectifying portion 46 in the connection tank 14, and then supplied to the water storage tank 16, so that it is possible to prevent the flush water vigorously spouted by the action of the water supply pressure from being slapped directly against a water surface, thereby further suppressing the water slapping sound.

In the above embodiment, the flow rectifying portion 46 is formed on the standing surface 27A. However, the present invention is not limited thereto. For example, in a case where flush water is suppled from the water supply port 26A of the water supply member 26 toward the transverse surface (bottom surface) 27B, the flow rectifying portion 46 may be provided on the transverse surface 27B. In this case, the flow rectifying portion 46 may be comprised of a concave part and a convex part each extending toward the water supply opening 24A. In the above embodiment, in the flow rectifying portion 46, the plurality of convex parts 46A and the plurality of concave parts 46B are formed alternately. Alternatively, only the convex parts 46A or only the parts 46B may be formed.

In the above embodiment, the flow rectifying portion 46 is comprised of a concave part and a convex part each extending toward the downstream side, i.e., toward the water supply opening 24A. However, the present invention is not limited thereto. For example, the flow rectifying portion 40 may be comprised of a lattice-shaped groove (concave part) or convex part, or a roughened surface consisting of fine irregularities.

The above embodiment has been described based on an example in which the tank device 4 comprises the connection tank 14 and the water storage tank 16. However, the present invention is not limited thereto, but may be applied to a tank device consisting only of a water storage tank, wherein the tank device is configured to supply water directly to the water storage tank. In this case, the flow rectifying portion may be formed on a region of an inner wall surface of the water storage tank to which flush water is spouted.

LIST OF REFERENCE SIGNS

1: flush toilet apparatus
2: toilet main unit
2*a*: bowl portion
2*b*: drainage trap conduit
4: tank device
6: water spouting pipe
6A: overflow pipe
8: water supplying pipe
10: tank main unit
12: valve unit
14: connection tank
16: water storage tank
18: water shutoff valve
20: constant flow rate valve
22: solenoid valve
22A: diaphragm
24: housing
24A: water supply opening
24B: overflow opening
24C: internal space
26: water supply member
26A: water supply port
27A: standing surface
27B: transverse surface
27C: top surface
30: check valve
32: tank body
32A: storage part
32B: opening
34: pump unit
34A: water passing pipe
36: float switch
38: drain plug
42: protruded portion
44: inclined surface
46: flow rectifying portion
46A: convex part
46B: concave part

The invention claimed is:

1. A tank device for supplying flush water stored therein to a flush toilet, comprising:

a tank main unit for storing flush water in an internal space thereof defined by an inner wall surface which comprises a transverse surface extending in a transverse direction and a standing surface extending in an up-down direction; and a water supply member for supplying flush water, which is used for cleaning the flush toilet, from a water supply port to the internal space of the tank main unit, wherein the water supply member is configured to spout flush water toward the inner wall surface defining the internal space, wherein the tank main unit comprises a flow rectifying portion provided in a region of the inner wall surface to which flush water is spouted, the flow rectifying portion having a concave part and/or a convex part each formed on the inner wall surface, and wherein the water supply member is configured to spout the flush water toward the standing surface, and the flow rectifying portion is formed on the standing surface.

2. The tank device according to claim 1, wherein the concave part and/or the convex part extend toward a downstream side of a flow of the flush water.

3. The tank device according to claim 1, wherein at least the region of the inner wall surface provided with the flow rectifying portion is formed to protrude outwardly.

4. The tank device according to claim 1, wherein the inner wall surface of the tank main unit located on a downstream side of a flow of the flush water with respect to the flow rectifying portion is linearly formed in sectional view.

5. The tank device according to claim 1, wherein the inner wall surface includes an inclined surface located on an upstream side of a flow of the flush water with respect to the flow rectifying portion, the inclined surface inclining from an inward side toward an outward side in sectional view.

6. The tank device according to claim 1, wherein the tank main unit comprises: a connection tank in which the water supply port is disposed; and a water storage tank for storing therein the supplied flush water, and wherein the flow rectifying portion is formed on an inner wall surface of the connection tank.

7. A tank device for supplying flush water stored therein to a flush toilet, comprising:

a tank main unit for storing flush water in an internal space thereof defined by an inner wall surface which comprises a transverse surface extending in a transverse direction and a standing surface extending in an up-down direction; and a water supply member for supplying flush water from a water supply port to the internal space of the tank main unit, wherein the water supply member is configured to spout flush water toward the inner wall surface defining the internal space, wherein the tank main unit comprises a flow rectifying portion provided in a region of the inner wall surface to which flush water is spouted, the flow rectifying portion having a concave part and/or a convex part each formed on the inner wall surface, and wherein the water supply member is configured to spout the flush water toward the standing surface, and the flow rectifying portion is formed on the standing surface.

8. A tank device for supplying flush water stored therein to a flush toilet, comprising:

a tank main unit for storing flush water in an internal space thereof defined by an inner wall surface which comprises a transverse surface extending in a transverse direction and a standing surface extending in an up-down direction; and a water supply member for supplying flush water from a water supply port to the internal space of the tank main unit, wherein the water supply member is configured to spout flush water toward the inner wall surface defining the internal space, wherein the tank main unit comprises a flow rectifying portion provided in a region of the inner wall surface to which flush water is spouted, the flow rectifying portion having a concave part and/or a convex part each formed on the inner wall surface, and wherein the inner wall surface includes an inclined surface located on an upstream side of a flow of the flush water with respect to the flow rectifying portion, the inclined surface inclining from an inward side toward an outward side in sectional view.

9. A tank device for supplying flush water stored therein to a flush toilet, comprising:

a tank main unit for storing flush water in an internal space thereof defined by an inner wall surface which comprises a transverse surface extending in a transverse direction and a standing surface extending in an up-down direction; and a water supply member for supplying flush water from a water supply port to the internal space of the tank main unit, wherein the water supply member is configured to spout flush water toward the inner wall surface defining the internal space, wherein the tank main unit comprises a flow rectifying portion provided in a region of the inner wall surface to which flush water is spouted, the flow rectifying portion having a concave part and/or a convex part each formed on the inner wall surface, and wherein the tank main unit comprises: a connection tank in which the water supply port is disposed; and a water storage tank for storing therein the supplied flush water, and wherein the flow rectifying portion is formed on an inner wall surface of the connection tank.

* * * * *